US005236472A

United States Patent [19]

Kirk et al.

[11] Patent Number: 5,236,472

[45] Date of Patent: Aug. 17, 1993

[54] ABRASIVE PRODUCT HAVING A BINDER COMPRISING AN AMINOPLAST BINDER

[75] Inventors: Alan R. Kirk; Eric G. Larson, both of St. Paul, Minn.

[73] Assignee: Minnesota Mining and Manufacturing Company, St. Paul, Minn.

[21] Appl. No.: 659,752

[22] Filed: Feb. 22, 1991

[51] Int. Cl.[5] ..... C09K 3/14

[52] U.S. Cl. ..... 51/298; 51/295; 51/307; 51/308; 51/309

[58] Field of Search ..... 51/295, 298, 307, 308, 51/309

[56] References Cited

U.S. PATENT DOCUMENTS

| | | | |
|---|---|---|---|
| 2,983,593 | 5/1961 | Duke | 51/298 |
| 3,775,113 | 11/1973 | Bonham et al. | 96/28 |
| 3,861,892 | 1/1975 | Wisdom, Jr. et al. | 51/295 |
| 3,887,450 | 6/1975 | Gilano et al. | 204/159.15 |
| 3,887,450 | 6/1975 | Gilano et al. | 204/159.15 |
| 3,895,949 | 7/1975 | Akamatsu et al. | 96/86 P |
| 4,035,961 | 7/1977 | Pemrick et al. | 51/295 |
| 4,047,903 | 9/1977 | Hesse et al. | 51/298 |
| 4,111,667 | 9/1978 | Adams | 51/295 |
| 4,214,877 | 7/1980 | Pemrick | 51/295 |
| 4,386,943 | 6/1983 | Gumbel et al. | 51/298 |
| 4,547,204 | 10/1985 | Caul | 51/298 |
| 4,588,419 | 5/1986 | Caul et al. | 51/295 |
| 4,735,632 | 4/1988 | Oxman et al. | 51/295 |
| 4,903,440 | 2/1990 | Larson et al. | 51/298 |
| 4,927,431 | 5/1990 | Buchanan et al. | 51/298 |

FOREIGN PATENT DOCUMENTS 0400658 5/1990 European Pat. Off. .

OTHER PUBLICATIONS

Zaugg, H. E.; W. B. Martin, "Alpha-Amido Alkylations at Carbon", *Organic Reactions*, vol. 14, John Wiley & Sons, Inc. (New York:1965), pp. 52-77.

Hellmann, H., "Amidomethylation", Newer Methods of Preparative Organic Chemistry, vol. II, Academic Press (New York & London:1963), pp. 277-302.

*Primary Examiner*—Mark L. Bell

*Assistant Examiner*—Willie J. Thompson

*Attorney, Agent, or Firm*—Gary L. Griswold; Walter N. Kirn; David L. Weinstein

[57] ABSTRACT

Abrasive products comprising abrasive grains bonded together or bonded to a backing by means of a binder compressing an oligomeric aminoplast resin having on average at least one pendant $\alpha,\beta$-unsaturated carbonyl group per oligomeric unit. The oligomeric aminoplast resins polymerize via free radical polymerization at the site of the $\alpha,\beta$-unsaturation. Polymerization is initiated by a source of free radicals. The source of free radicals can be generated by electron beam radiation or by an appropriate curing agent or initiator upon exposure to heat or radiation energy. The coated abrasive of this invention demonstrates improved grinding performance under severe conditions as compared with coated abrasives comprising radiation curable resins heretofore known.

30 Claims, 1 Drawing Sheet

ABRASIVE PRODUCT HAVING A BINDER COMPRISING AN AMINOPLAST BINDER

BACKGROUND OF THE INVENTION

1. Field of the Invention

This invention relates to abrasive products having a resinous binder. The abrasive products can be bonded abrasives, coated abrasives, or nonwoven abrasives.

2. Discussion of the Art

Coated abrasives generally comprise a flexible backing upon which a binder holds and supports a coating of abrasive grains. The backing can be selected from the group consisting of paper, cloth, film, vulcanized fiber, etc. or a combination of one or more of these materials, or treated versions thereof. The abrasive grains can be formed of flint, garnet, aluminum oxide, ceramic aluminum oxide, alumina zirconia, diamond, silicon carbide, etc. Binders are commonly selected from phenolic resins, hide glue, urea-formaldehyde resins, urethane resins, epoxy resins, and varnish.

The coated abrasive may employ a "make" coat of resinous binder material in order to secure the abrasive grains to the backing as the grains are oriented, and a "size" coat of resinous binder material can be applied over the make coat and abrasive grains in order to firmly bond the abrasive grains to the backing. The binder material of the size coat can be the same material as the binder material of the make coat or of a different material.

In the manufacture of coated abrasives, the make coat and abrasive grains are first applied to the backing, then the size coat is applied, and finally, the construction is fully cured. Generally, thermally curable binders provide coat abrasives with excellent properties, e.g., heat resistance. Thermally curable binders include phenolic resins, urea-formaldehyde resins, urethane resins, melamine-formaldehyde resins, epoxy resins, and alkyd resins. In order to obtain the proper coating viscosities, solvent is commonly added to these resins. When polyester or cellulosic backings are used, curing temperature is limited to about 130° C. At this temperature, cure time are long. The long cure time along with the solvent removal necessitates the use of festoon curing areas. Disadvantages of festoon curing areas include the formation of defects at the suspension rods, inconsistent cure due to temperature variations in the large festoon ovens, sagging of the binder, wrinkling of very flexible webs, and shifting of abrasive grains. Furthermore, festoon curing areas require large amounts of space and enormous amounts of energy.

Radiation curing processes have been used in an attempt to avoid the disadvantages of festoon ovens. For example, Offenlegungsschrift 1,956,810 discloses the use of radiation for the curing of unsaturated polyester resins, acid hardenable urea resins, and other synthetic resins especially in mixtures with styrene. U.S. Pat. No. 4,047,903 discloses a radiation curable binder comprising a resin prepared by at least partial reaction of (a) epoxy resins having at least 2 epoxy groups e.g., from diphenylolpropane and epichlorohydrin, with (b) unsaturated monocarboxylic acids, and (a) optionally polycarboxylic acid anhydride. U.S. Pat. No. 4,547,204 discloses the use of radiation curable acyrlated epoxy resins in one adhesive layer of the coated abrasive and the use of a heat curable phenolic or acrylic latex resin in another adhesive layer of the coated abrasive.

Although radiation curable resins solve the problems associated with thermally curable resins, with respect to festoon ovens, the radiation curable resins are generally more expensive than the thermally curable resins. In many abrasive products this increase in cost cannot be tolerated and thermally curable resins are still utilized. Also, radiation curable resins generally do not exhibit the heat resistance necessary for severe coarse grit coated abrasive applications. In an attempt to solve these problems, U.S. Pat. No. 4,588,419 discloses an adhesive for coated abrasives comprising a mixture of: (a) electron beam radiation curable resin system comprising an oligomer selected from the group consisting of urethane acrylates and epoxy acrylates, a filler, and a diluent and (b) a thermally curable resin selected from the group consisting of phenolic resins, melamine resins, amino resins, alkyd resins, and furan resins. U.S. Pat. No. 4,927,431 discloses an adhesive for coated abrasives comprising a mixture of: (a) radiation curable monomer selected from the group consisting of isocyanurate derivatives having at least one terminal or pendant acrylate group, isocyanate derivatives having at least one terminal or pendant acrylate group, and multifunctional acrylates having on average at least three pendant acrylate groups, (b) a thermally curable resin selected from the group consisting of: phenolic resins, epoxy resins having an oxirane ring, urea-formaldehyde resins, melamine-formaldehyde resins, and polyimide resins. However, the radiation curable resin and the thermally curable resin disclosed in these patents do not co-react or copolymerize. It is desired that the radiation curable resin and the thermally curable resin copolymerize in order to form a tightly crosslinked network, thereby providing improved thermal properties necessary for severe coated abrasive applications.

U.S. Pat. No. 4,903,440 discloses an abrasive article comprising abrasive grains and a binder formed from a precursor compressing an aminoplast resin having on average at least 1.1 pendant $\alpha,\beta$-unsaturated carbonyl groups per molecule. It is also taught in this patent that the abrasive article can further contain a thermally curable resin, such as phenolic resin. In this particular embodiment, the aminoplast resin and the phenolic resin can co-react or copolymerize to form a binder that has a tightly crosslinked network.

SUMMARY OF THE INVENTION

This invention provides abrasive products comprising abrasive grains boded together or bonded to a backing by means of a binder comprising an oligomeric aminoplast resin having on average at least one pendant $\alpha,\beta$-unsaturated carbonyl group per oligomeric unit. The so called $\alpha,\beta$-unsaturated carbonyl groups include acrylates, methacrylates, acrylamides, and methacrylamides. The oligomeric aminoplast resins polymerize via free radical polymerization at the site of the $\alpha,\beta$-unsaturation. Polymerization is initiated by a source of free radicals. The source of free radicals can be generated by electron beam radiation or by an appropriate curing agent or initiator. If a curing agent or initiator is employed, then free radicals can be generated by exposing the curing agent or initiator to either heat or radiation energy. In addition, the oligomeric aminoplast resins can also contain pendant amino (—NHR) or hydroxy (—OH) functional groups or both. Polymerization can occur at the sites of the —NHR and —OH functional groups via a condensation reaction. The R substituent of the —NHR group is typically a hydrogen atom or a hydrocarbon, which may be substituted or unsubstituted, but if substituted, the substituents should be those that do not inhibit or prevent polymerization. Typical examples of the R substituent include alkyl, e.g., methyl, ethyl, aryl, e.g., phenyl, alkoxy, and carbonyl.

In one embodiment of this invention, conventional thermally curable resins, such as phenolic, urea-formaldehyde, melamine-formaldehyde epoxy, and furfural resins can be added to the oligomeric aminoplast resin which forms the precursor of the binder. These resins can copolymerize with each other or with the oligomeric aminoplast resin at the sites of the —NHR or —OH functional groups.

Preferably, the binder precursors for use in the abrasive articles of this invention are selected from the groups consisting of:

A. oligomeric aminoplast resin having on average at least one, more preferably at least 1.1, pendant, $\alpha,\beta$-unsaturated carbonyl groups per oligomeric unit, B. oligomeric aminoplast resin having on average at least one pendant, $\alpha,\beta$-unsaturated carbonyl group per oligomeric unit and at least one pendant —NHR or —OH functional group per oligomeric unit, C. a blend of at least one condensation curable resin and at least one oligomeric aminoplast resin having on average at least one pendant $\alpha,\beta$-unsaturated carbonyl group per oligomeric unit and at least one pendant —NHR or —OH functional group per oligomeric unit, D. a blend of at least one ethylenically unsaturated compound and at least one oligomeric aminoplast resin having on average at least one pendant $\alpha,\beta$-unsaturated carbonyl group per oligomeric unit, E. a blend of at least one ethylenically unsaturated compound and at least one oligomeric aminoplast resin having on average at least one pendant $\alpha,\beta$-unsaturated carbonyl group per oligomeric unit and at least one pendant —NHR or —OH functional group per oligomeric unit, F. a blend of at least one ethylenically unsaturated compound, at least one oligomeric aminoplast resin having on average at least one pendant $\alpha,\beta$-unsaturated carbonyl group per oligomeric unit and at least one pendant —NHR or —OH functional group per oligomeric unit, and at least one condensation curable resin, G. a blend of at least one oligomeric aminoplast resin having on average at least one pendant $\alpha,\beta$-unsaturated carbonyl groups per oligomeric unit and at least one condensation curable resin.

The method of preparing the abrasives of this invention eliminates the problems associated with both radiation curable resins and thermally curable resins. The mixing of radiation curable resins with thermally curable resins results in a reduced cost, as compared with a composition containing radiation curable resins only, and eliminates the need for festoon ovens. The performance of the coated abrasives of the present invention equals or exceeds that of coated abrasives formed with thermally curable phenolic resins. The coated abrasive of this invention demonstrates improved grinding performance under severe conditions as compared with coated abrasives comprising radiation curable resins heretofore known.

DETAILED DESCRIPTION

Figure 2:
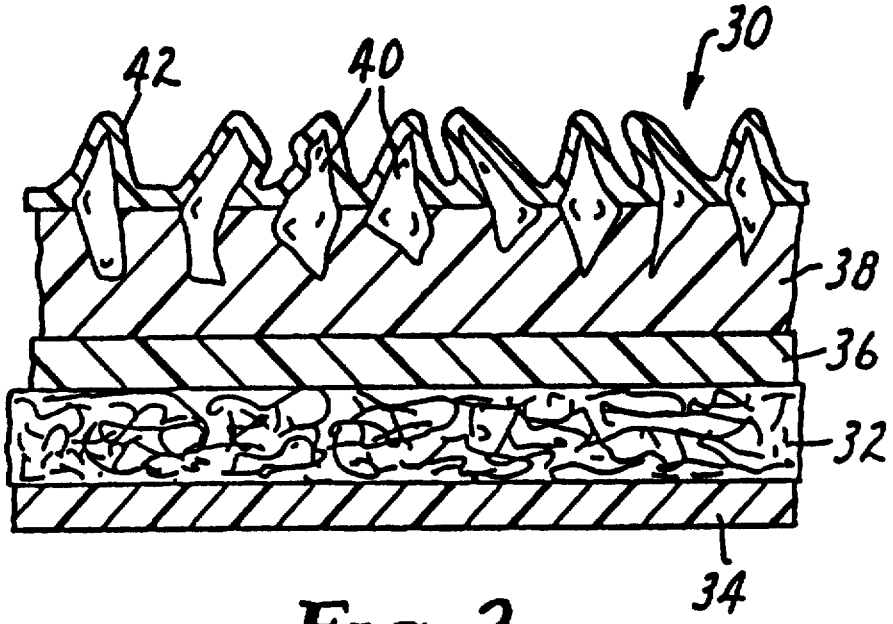
FIG. 2 illustrates in cross section a coated abrasive on a paper backing.
Figure 1:
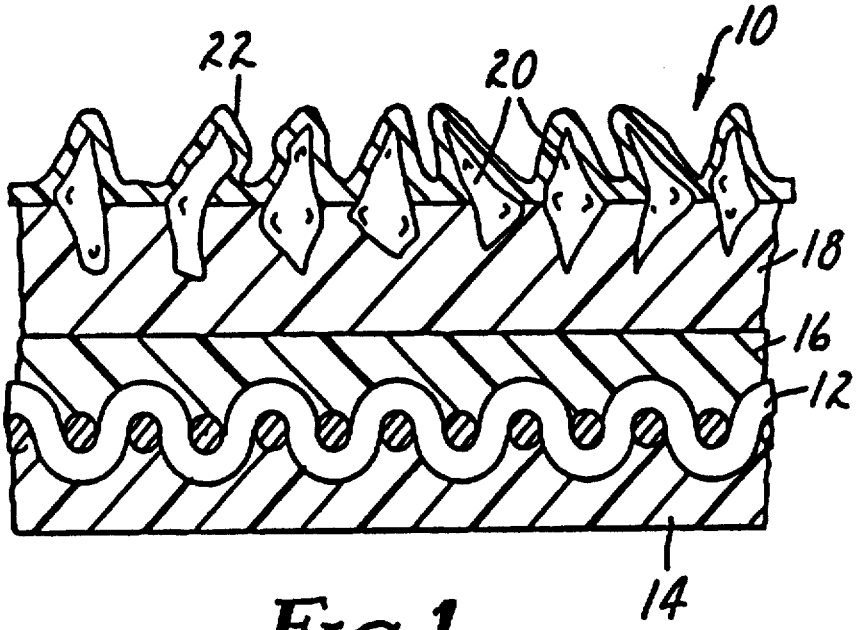
FIG. 1 illustrates in cross section a coated abrasive on a cloth backing.

Coated abrasive articles that may be produced by the resins systems of this invention are illustrated in FIGS. 1 and 2. As illustrated in FIG. 1, the coated abrasive article generally indicated at 10 is cloth backed. Cloth 12 has been treated with a optional back size coat 14 and an optional presize coat 16. Overlying the presize coat is a make coat 18 in which are embedded abrasive grains 20. A size coat 22 has been placed over the make coat 18 and the abrasive grains 20. There is no clear line demarcation between the backsize coat and the presize coat which meet in the interior of the cloth backing.

In FIG. 2, there is illustrated a coated abrasive article generally indicated as 30 which is formed on a paper backing 32. Paper backing is treated with a back size coat 34 and presize coat 36. The presize coat is overcoated with a make coat 38 in which are embedded abrasive grains 40. The abrasive grains 40 and make coat 38 are overcoated with a size coat 42 which aids in holding the abrasive grains 40 onto the backing during utilization and further may contain grinding aids.

As used herein, the phrase "binder precursor" means a resinous material which either secures the abrasive grains to a backing or secures the abrasive grains together to form a shaped mass. Upon polymerization or curing, the binder precursor becomes a binder. The binder precursor of this invention comprises an oligomeric aminoplast resin having on average at least one pendant $\alpha,\beta$-unsaturated carbonyl group per oligomeric unit. As used herein, "oligomeric aminoplast resin" is the same as "oligomeric aminoplast resin having on average at least one pendant $\alpha,\beta$-unsaturated carbonyl group per oligomeric unit".

The oligomeric aminoplast resin of this invention is considered to be an oligomer. In general, an oligomer has a repeating chemical structure or unit. Oligomers, as defined in R. B. Seymour & C. E. Carraher, Jr., Polymer Chemistry, 2nd Ed., are very low molecular weight polymers in which the number of repeating units (n) equals 2 to 10. A monomer, on the other hand, consists of one unit, i.e., n equals one. There are no repeating units in a monomer. Oligomers tend to have higher molecular weight and tend to be more viscous than monomers. However, oligomers tend to have better thermal properties than monomeric materials.

In general, aminoplast resins refer to the class of thermosetting resins obtained by the reaction of amino compounds with aldehydes to produce compounds having hyroxyalkyl groups. The most common aldehyde is formaldehyde, which reacts with the amino group (—NHR) to produce compounds having hydroxymethyl groups. Other commonly used aldehydes include acetaldehyde, glutaraldehyde, glyoxylic acid, acetals, malondialdehyde, glyoxal, furfural, and acrolein. Compounds having hydroxyalkyl groups will either condense with each other or with compounds having amino groups to produce a crosslinked thermosettable network. Aminoplasts are thermosetting, and when crosslinked, produce an insoluble and infusible resinous network. The crosslinked aminoplast resins of this invention have high strength, rigidity, dimensional stability, heat resistance, and absence of cold flow. Aminoplasts have on average more than one reactive site per molecule. The reactive site can either be an —NHR or an —OH functional group. The R substituent of the —NHR groups is typically a hydrogen atom or a hydrocarbon, which may be substituted or unsubstituted, but if substituted, the substituent or substituents should be those that do not inhibit or prevent polymerization. Typical examples of the R substituent include alkyl, e.g., methyl, ethyl, aryl, e.g., phenyl, alkoxy, and carbonyl. Representative examples of aminoplast resins include urea-formaldehyde, melamine-formaldehyde, guanamine resins such as benzoguanamine-formaldehyde and acetoguanamine-formaldehyde, aniline-formaldehyde, toluenesulfonamide-formaldehyde, acrylamide-formaldehyde, and ethyleneurea-formaldehyde.

To form the aminoplast resins specifically suitable for the present invention, the amino compound is first reacted with the aldehyde so that at least one of the —NHR groups in the amino compound is reacted with the aldehyde; the resulting product is then reacted with a second compound, which is oligomeric in nature, to produce an oligomeric aminoplast resin having on average at least one pendant $\alpha,\beta$-unsaturated carbonyl group per oligomeric unit.

In order to form an aminoplast resin with the requisite number of pendant $\alpha,\beta$-unsaturated carbonyl groups per oligomeric unit, the starting aminoplast must have on average at least one activated or reactive —NHR groups per molecule or oligomeric unit. The starting amino compound can be added to a reaction vessel along with an aldehyde in a molar ratio of one mole aminoplast to between one to m moles aldehyde, where m is the number of reactive hydrogens of the aminoplast. Formaldehyde is the preferred aldehyde and is commercially available, typically as a 37% aqueous solution. This reaction mixture is heated between 40° to 80° C. to cause the following reaction, depending upon the starting materials:

REACTION I

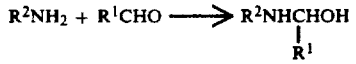

where $R^1CHO$ represents an aldehyde; $R^2NH_2$ represents an amino group; $R^1$ represents a member of the group selected from hydrogen, alkyl group, preferably having 1 to 20 carbon atoms, inclusive, alkenyl group, preferably having 1 to 20 carbon atoms, inclusive, and aryl group, preferably having 1 ring; $R^2$ represents any deactivating group which will allow the reaction to occur. As used herein, a "deactivating group" is an electron-withdrawing group, such as carbonyl, sulfonyl, chloro, and aryl. When $R^1$ represents an alkyl group, alkenyl group, or aryl group, it can be substituted or unsubstituted. If $R^1$ is substituted, the substituent can be any group that does not interfere with Reaction I. Examples of $R^1CHO$ include formaldehyde, propionaldehyde, benzaldehyde. Examples of $R^2$ include a carbonyl group, a triazine ring, a deactivated ring, or a sulfonyl group. The hydrogen atom attached to the nitrogen atom is considered to be a reactive hydrogen with respect to further condensation.

The amino compound with the hydroxyalkyl group(s) is then reacted with an oligomeric material to form the oligomeric aminoplast having on average at least one pendant $\alpha,\beta$-unsaturated carbonyl group per oligomeric unit. These oligomeric materials typically have between 2 and 10 repeating monomeric sections. This oligomer material forms the backbone of the oligomeric aminoplast resin. This oligomeric material must have on average at least one pendant reactive site to form the oligomeric aminoplast resin suitable for use in this invention. These reactive sites react with the hydroxyalkyl group from the aminoplast to form unsaturated aminodoalkyl substituents. Examples of such oligomeric materials include phenol novolac resins, and the novolacs of cresols, naphthols, and resorcinols.

The preferred oligomeric material is a phenol novolac resin. Typically the phenol novolac resin is made by reacting a phenol monomer with an aldehyde in the presence of an acid catalyst, with the molar ratio of the aldehyde to phenol being less than one. Examples of aldehydes used to prepare novolacs include formaldehyde, acetaldehyde, propionaldehyde, glyoxal, and furfural. The preferred aldehyde is formaldehyde because of its availability, reactivity, and low cost. A typical phenol novolac resin is illustrated below:

CHEMICAL STRUCTURE E

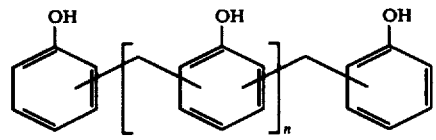

There are essentially no hydroxymethyl groups present for further condensation. Typically these materials have a molecular weight ranging from about 300 to about 1,500. Additionally, the starting phenol monomer can be substituted with various groups such as alkyl, alkoxy, carboxyl, sulfonic acid, so long as there are at least two reactive sites remaining to form the novolac.

Instead of using the phenol monomer, other chemicals can be reacted with the aldehyde to produce a novolac type resin. Examples of these chemicals include: cresol, xylenol, resorcinol, catechol, bisphenol A, naphthols or combinations thereof to form a novolac resin.

To form the oligomeric aminoplast resin of this invention, the aminoplast having hydroxyalkyl groups and the oligomeric material are first combined in a reaction vessel along with an acid catalyst. Representative examples of acid catalysts include trifluoroacetic acid, p-toluenesulfonic acid, and sulfuric acid. Then, the reaction mixture is gently heated to about 30° to 100° C., preferably 70° to 80° C. to bring about any one of the following reactions:

REACTION II

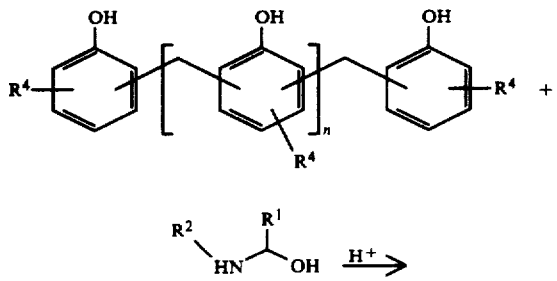

-continued

REACTION II

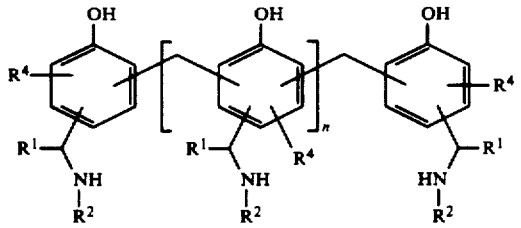

REACTION III

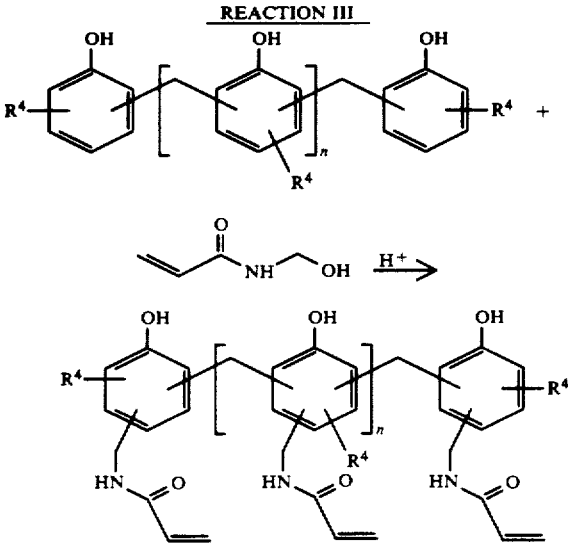

REACTION IV

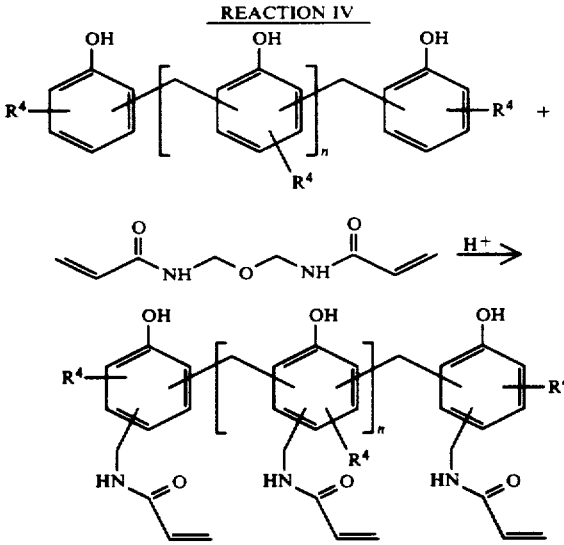

REACTION V

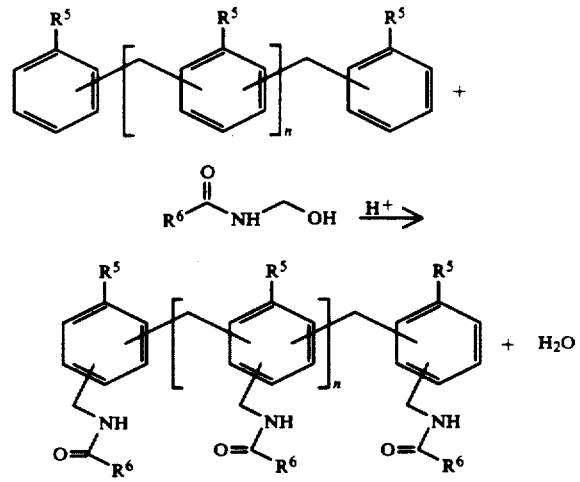

where $R^1$ is as defined above; $R^4$ represents a substituent, or combination of substituents, that does not adversely affect the reaction; $R^5$ represents —OH, —SH, —$NH_2$, hydrogen, alkylamino group, alkylthio group, alkyl group, or alkoxy group; $R^6$ represents an $\alpha,\beta$-unsaturated alkenyl group. The alkylamino, alkylthio, alkyl, alkoxy and alkenyl groups of $R^5$ and $R^6$ preferably have 1 to 20 carbon atoms, inclusive. Examples of substituents suitable for $R^4$ include hydrogen, alkyl group, preferably having 1 to 20 carbon atoms, inclusive, alkoxy group, preferably having 1 to 20 carbon atoms, inclusive, —OH group, mercapto group, and other groups that activate the aromatic ring toward electrophilic substitution. These types of reactions are commonly referred to as Tscherniac-Einhorn reactions.

There may be side reactions and other products formed from Reactions II through IV.

Examples of the type of reaction encompassed by Reaction V can be found in the following references: Zaugg, H. E.; W. B. Martin, "Alpha-Amido alkylations at Carbon", Organic Reactions, Vol. 14, 1965 pages 52 to 77; and Hellmann, H., "Amidomethylation", Newer Methods of Preparative Organic Chemistry, Vol. II, Academic Press (New York and London; 1963), pp. 277-302, both of which are incorporated herein by reference.

In Reactions II through IV, the first reactant is a typical example of an oligomeric material. In the reactants in Reactions II through IV, n is preferably an integer between 0 and 8, because on both sides of the n group there is a monomeric repeating unit. Thus, when these two monomeric repeating units are added to n, the total number of repeating units is between 2 and 10.

Another series of oligomeric aminoplast resins having on average at least one pendant $\alpha,\beta$-unsaturated group is illustrated below as chemical structures A, B, C, and D. These classes of oligomeric aminoplast resins are commercially available from the Monsanto Company, St. Louis, Mo. under the trade designation Santolink AM products.

CHEMICAL STRUCTURE A

-continued

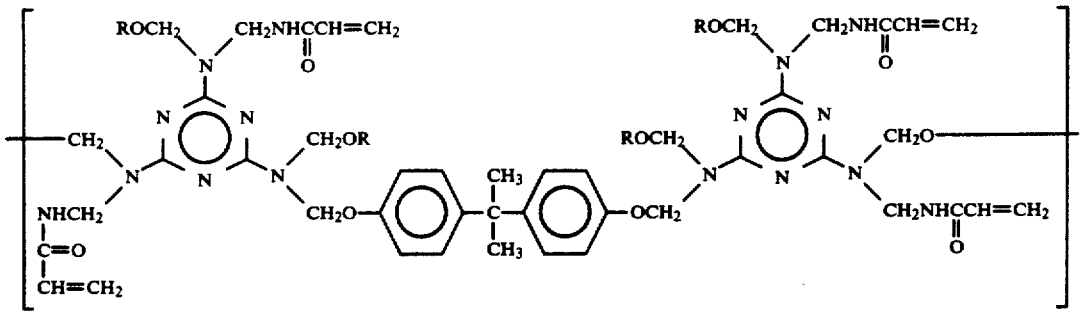

CHEMICAL STRUCTURE B

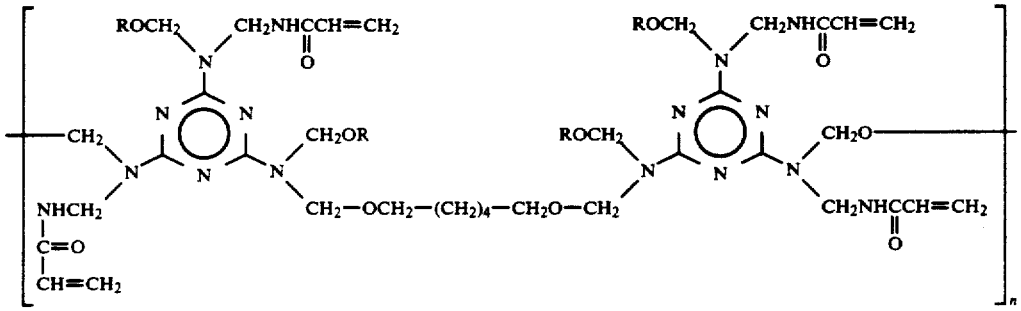

CHEMICAL STRUCTURE C

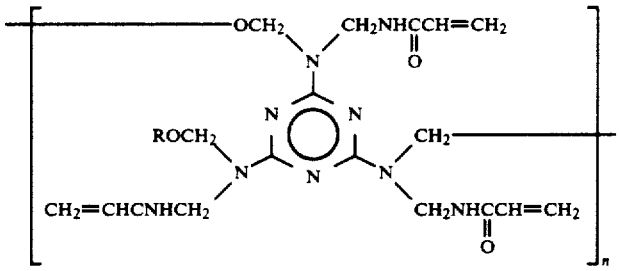

CHEMICAL STRUCTURE D

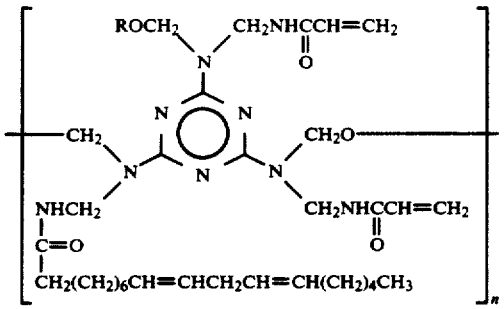

The particular oligomeric aminoplast resin is selected on the basis of the type of abrasive product in which it ultimately will be used. If the product is a fine grade coated abrasive where flexibility and conformability are important properties, the starting oligomeric material for forming the oligomeric aminoplast resin of the invention can be derived from urea. If the product is a coarse grade coated abrasive, where hardness and heat resistance are important properties, the starting oligomeric material for forming the oligomeric aminoplast resin of the invention can be derived from an aromatic oligomeric material.

While aminoplast resins are known in the art as suitable binders for abrasive articles, as demonstrated in U.S. Pat. Nos. 2,983,593; 3,861,892; 4,035,961; 4,111,667; 4,214,877 and 4,386,943, none of these references disclose an oligomeric aminoplast resin having on average at least one pendant $\alpha,\beta$-unsaturated carbonyl groups per oligomeric unit.

For the binder of the abrasive article, if the oligomeric aminoplast resin is used alone, i.e., not used in a blend with another resin or chemical compound, the oligomeric aminoplast resin should have on average at least 1.1 pendant $\alpha,\beta$-unsaturated carbonyl groups per oligomeric unit. This number of groups is necessary to bring about crosslinking during polymerization. If the aminoplast had on average at least one pendant $\alpha,\beta$-unsaturated carbonyl groups, a linear polymer can form during polymerization. Linear polymers do not have enough strength and hardness to be used as binders for abrasive articles.

However, if the oligomeric aminoplast resin of the invention has, in addition to the $\alpha,\beta$-unsaturated carbonyl groups, at least one pendant —NHR or —OH functional groups per oligomeric unit, the oligomeric aminoplast resin can have on average as low as one pendant $\alpha,\beta$-unsaturated carbonyl group per oligomeric unit. The —NHR and —OH functional groups polymeric via a condensation mechanism, in the presence of a curing agent, e.g., formaldehyde, hexamethylene tetramine, thereby resulting in a crosslinked polymer. Additionally, if the oligomeric aminoplast resin of the invention is combined with either condensation curable resins or ethylenically unsaturated compounds, then the oligomeric aminoplast resin can have on average as low as one pendant $\alpha,\beta$-unsaturated carbonyl group per oligomeric unit. The condensation curable resins or the ethylenically unsaturated compound will polymerize and form a crosslinked thermoset polymer.

Additionally, the binder precursor of this invention can comprises a blend of the oligomeric aminoplast resin with a condensation curable resin or ethylenically unsaturated compound. The bond system comprises the binder precursor of this invention plus other additives that are commonly used in the abrasive industry. These other additives include fillers, grinding aids, dyes, pigments, coupling agents, surfactants, lubricants, etc. During the manufacture of the abrasive article, the binder precursor containing the oligomeric aminoplast resin having on average at least one pendant $\alpha,\beta$-unsaturated carbonyl group per oligomeric unit is in an uncured or unpolymerized state.

If condensation curable resins are employed in the binder of this invention, they are typically selected from the group consisting of: phenolic, urea-formaldehyde and melamine-formaldehyde resins. Phenolic resins are the preferred resin because of their thermal properties, availability, cost and ease of handling. There are two types of phenolic resins: resole and novolac. Resole phenolic resins are characterized by alkaline catalysts and the ratio of formaldehyde to phenol is greater than or equal to one, typically between 1.5 to 3.0. These alkaline catalysts include sodium hydroxide, barium hydroxide, potassium hydroxide, calcium hydroxide, organic amines, or sodium carbonate. Resole phenolic resins are thermosetting resins and, when cured, exhibit excellent toughness, dimensional stability, strength, hardness, and heat resistance.

The above-mentioned properties make a resole phenolic resin ideal as a binder for abrasive grains. However, when coated abrasive products are used under wet conditions, the resole phenolic resin softens on account of its sensitivity to moisture. As a consequence, the performance of the coated abrasive is reduced. However, this invention overcomes this problem by blending the oligomeric aminoplast resin of the invention with a resole phenolic resin. An abrasive product utilizing this resin system has improved resistance to moisture as compared with a 100% phenolic resin, and consequently, improved grinding performance under the conditions.

Both the resole and novolac phenolic resins, with the addition of an appropriate curing agent or initiator, are cured by heat. Temperature and pH significantly affect the mechanism of polymerization and the properties of the cured resin. Examples of commercially available phenolic resins are designated by the following tradenames: Varcum, Occidental Chemical Corporation; Aerofene, Ashland Chemical Co.; Bakelite, Union Carbide; and Resinox, Monsanto.

The ratio between the aminoplast having on average one pendant $\alpha,\beta$-unsaturated carbonyl group to the condensation curable resin can range from about 90 parts by weight to about 10 parts by weight to from about 10 parts by weight to about 90 parts by weight, preferably from about 50 parts by weight to 50 parts by weight to from about 25 parts by weight to about 75 parts by weight.

Conventional aminoplast resins not having a pendant $\alpha,\beta$-unsaturated carbonyl group can be added to the binder of this invention and copolymerized through the site of the —OH or the —NHR groups of aminoplasts having $\alpha,\beta$-unsaturated carbonyl groups.

1,2-Epoxide group-containing compounds useful in the polymerizable mixture of this invention have an oxirane ring, i.e.,

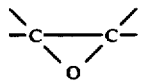

and the compound is polymerized by ring opening. The epoxy resins and the aminoplast can co-polymerize at the —OH site of the aminoplast. This reaction is not a condensation reaction but an opening of the epoxy ring initiated by an acidic or basic catalyst. Such compounds, broadly called epoxides, include monomeric epoxy compounds and polymeric epoxy compounds, and may vary greatly in the nature of their backbones and substituent groups. For example, the backbone may be of any type and substituent groups thereon can be any group free of an active hydrogen atoms which is reactive with an oxirane ring at room temperature. Representative examples of acceptable substituent groups include halogens, ester groups, ether groups, sulfonate groups, siloxane groups, nitro groups, and phosphate groups. The molecular weight of the epoxy-containing materials can vary from about 60 to about 4000,and preferably range from about 100 to 600. Mixtures of various epoxy-containing materials can be used in the compositions of this invention.

Ethylenically unsaturated compounds can also be blended with the binder precursor of the invention to modify the final properties where so desired. These compounds can copolymerize with the pendant $\alpha,\beta$-unsaturated carbonyl groups of the oligomeric aminoplast resin.

Ethylenically unsaturated compounds suitable for this invention include monomeric or polymeric compounds that contain atoms of carbon, hydrogen, and oxygen, and optionally, nitrogen and the halogens. Oxygen and/or nitrogen atoms are generally present in ether, ester, urethane, amide and urea groups. The compounds preferably have a molecular weight of less than about 4,000. preferred compounds are esters of aliphatic monohydroxy and polyhydroxy group containing compounds and unsaturated carboxlic acids, such as acrylic acid, methacrylic acid, itaconic acid, crotonic acid, isocrotonic acid, maleic acid, and the like. Representative examples of preferred ethylenically unsaturated compounds include methyl methacrylate, ethyl methacrylate, styrene, divinylbenzene, vinyl toluene, ethylene glycol diacrylate and methacrylate, hexanediol diacrylate, triethylene glycol diacrylate and methacrylate, trimethylolpropane triacrylate, glycerol triacrylate, pentaerythritol triacrylate and methacrylate, pentaerythritol tetraacrylate and methacrylate, dipentaerythritol pentaacrylate, sorbitol triacrylate, sorbitol hexaacrylate, bispenol A diacrylate, and ethoxylated bisphenol A diacrylate. Other examples of ethylenically unsaturated compounds include ethylene glycol diitaconate, 1,4-butanediol diitaconate, propylene glycol dicrotonate, dimethyl maleate, and the like. Other ethylenically unsaturated compounds include monoallyl, polyallyl, and polymethallyl esters and amides of carboxylic acids, such as diallyl phthalate, diallyl adipate, and N,N-diallyladipamide. Still other nitrogen-containing compounds include tris(2-acryloyl-oxyethyl-)isocyanurate, 1,3,5-tri(2-methacryloxyethyl)-s-triazine, acrylmide, methacrylamide, N-methacrylamide, N,N-dimethylacrylamide, N-vinylpyrrolidone, and N-vinylpiperidone. It is preferred that the ethylenically unsaturated compounds be acrylic compounds because of their ready availability and high rate of cure.

As mentioned previously, the bond system of the abrasive article comprises a binder precursor and optional additives. These additives include fillers, fibers, lubricants, grinding aids, wetting agents, surfactants, pigments, dyes, coupling agents, plasticizers, and suspending agents. The amounts of these materials are selected to give the properties desired.

It is preferred to add a filler with the oligomeric aminoplast resin of the invention to form the bond system. The fillers can be selected from any filler material that does not adversely affect the characteristics of the bond system. Preferred fillers include calcium carbonate, calcium oxide, calcium metasilicate, alumina trihydrate, cryolite, magnesia, kaolin, quartz, and glass. Fillers that function as grinding aids include cryolite, potassium fluoroboarate, feldspar, and sulfur. Fillers can be used in amounts up to about 250 parts by weight, preferably from about 30 to about 150 parts by weight, per 100 parts by weight of binder precursor while retaining good flexibility and toughness of the cured binder.

The oligomeric aminoplast resin polymerizes via free radical polymerization at the site of the $\alpha,\beta$-unsaturation. Polymerization can be initiated by a source of free radicals. The source of free radicals can be generated by electron beam radiation or by an appropriate curing agent or initiator. If a curing agent or initiator is employed, then the source of free radicals is generated by exposing the curing agent or initiator to either heat or radiation energy. During the manufacturing process, the binder precursor is either exposed to radiation energy and/or heat, which ultimately initiates the polymerization or curing of the oligomeric aminoplast resin. After the polymerization or curing step, the oligomeric aminoplast is no longer a resin, but a thermoset polymer.

Electron beam radiation is also known as ionizing radiation and has preferably a dosage level of 0.01 to 20 Mrad, more preferably a dosage level of 0.1 to 10 Mrad. The amount of electron beam radiation depends upon the degree of polymerization or cure desired of the binder.

Examples of curing agents or initiators that generate a source of free radicals when exposed to elevated temperatures, include peroxides, e.g., benzoyl peroxide, azo compounds, benzophenones, and quinones.

If the binder precursor contains a thermal initiator and it is desired to cure the binder precursor by heat, the temperature of the oven should be set to 100° C. for 4 hours. Long cures, i.e., 12 hours at 100° C., can be employed, especially if the binder contains a resole phenolic resin. The curing temperature is limited to the temperatures that the synthetic backings or paper backings used in abrasive products can withstand.

Examples of curing agents or initiators that when exposed to ultraviolet light generate a free radical source include organic peroxides, azo compounds, quinones, benzophenones, nitroso compounds, acryl halides, hydrazones, mercapto compounds, pyrylium compounds, triacylimidazoles, bisimidazoles, haloalkyltriazines, benzoin ethers, benzil ketals, thioxanthones, and acetophenone derivatives. Additional references to free radical photoinitiator systems for ethylenically-unsaturated compounds are included in U.S. Pat. No. 3,887,450 (e.g., col. 4) and U.S. Pat. No. 3,895,949 (e.g., col. 7). Other desirable photoiniatators are chloroalkyltriazines as disclosed in U.S. Pat. No. 3,775,113. Another good reference to free-radical photoinitiator systems is J. Kosar, Light-Sensitive Systems, J. Wiley and Sons, Inc. (1965), especially Chapter 5. Ultraviolet radiation means non particulate radiation having a wavelength within the range of 200 to 700 nanometers, more preferably between 250 to 40 nanometers.

Examples of curing agents or initiators that can generate a source of free radicals when exposed to visible light are disclosed in assignee's U.S. Pat. No. 4,735,632, incorporated hereinafter by reference. Visible light radiation means non particulate radiation having a wavelength within the range of 400 to 800 nanometers, more preferably between 400 to 550 nanometers. The rate of curing with any energy source varies according to the resin thickness as well as the density and nature of composition.

The backing of the coated abrasive, as previously mentioned, can be paper, cloth, vulcanized fiber, film, or any other backing material known for this use. The oligomeric aminoplast resin of the invention can be used to treat the backing material, e.g., cloth, paper, or plastic sheeting, to saturate or provide a back or front coat thereto, to provide a make coat to which abrasive grains are initially anchored, or to provide a size or reinforcing coat for tenaciously holding abrasive grains to the backing material.

The binder precursor of the present invention can be applied to the backing on one or more treatment steps to form a treatment coat. The treatment coat can be cured by a source of radiation energy, or can optionally be further cured thermally in a drum form. There is no need to cure the backing in festoon ovens in order to set the treatment coat or coats. It is preferable to cure the treatment coat or coats via the radiation energy source only. After the backing has been treated with a treatment coat, the make coat can be applied. After the make coat is applied, the abrasive grains are applied over the make coat. Next, the make coat, now bearing abrasive grains, is exposed to a source of radiation, and, optionally, to heat by means of a drum cure, which generally solidifies or sets the binder sufficiently to hold the abrasive grains to the backing. It is preferable to use only the radiation source to set the make coat. Then, the size coat is applied, and the size coat/abrasive grain/make coat combination is exposed to a radiation source or to a heat source, preferably via a drum cure. This process will substantially cure or set the make and size coat used in the coated abrasive constructions.

In the manufacture of a coated abrasive product, the binder precursor of this invention can be used as a treatment coat for the backing, e.g., cloth, paper, or plastic sheeting, to saturate or provide a back coat (backsize coat) or front coat (presize coat) thereto, as a make coat to which abrasive grains are initially anchored, as a size coat for tenaciously holding abrasive grains to the backing, or for any combination of the aforementioned coats. The binder precursor of this invention can also be used to form a supersize coat. In addition, the binder precursor of this invention can be used in coated abrasive articles where only a single coat binder is employed, i.e., where a single coat takes the place of a make coat/size coat combination.

The binder of the present invention only needs to be in at least one of the binder layers, i.e., treatment coat, or make coat, or size coat, comprising the coated abrasive product. It does not need to be in every binder layer; the other binder layers can utilize various other resinous systems known in the art. If the binder of the present invention is in more than one layer, the source of radiation does not need to be the same for curing each layer of the coated abrasive.

It is also contemplated that the oligomeric aminoplast resin of the invention can be employed as a binder precursor for non-woven abrasive products. Non-woven abrasive products typically include an open, porous, lofty, polymeric filmanetous structure having abrasive grains distributed throughout the structure and adherently bonded therein by an adhesive binder or resinous binder. Methods of making such non-woven abrasive products are well known in the art.

The binder precursor of this invention can also be used for bonded abrasive products. Resinous bonded abrasive products typically consist of a shaped mass of abrasive grains held together by an organic or vitrified binder material. The shaped mass is preferably in the form of a grinding wheel. Bonded abrasive products are typically manufactured by a molding process. The organic binder in the bonded abrasive is typically cured by heat. In many instances, there are two or more organic binder precursors present in a bonded abrasive. The first organic binder precursor is present in liquid form prior to polymerization or curing and wets the abrasive grain. The second organic binder precursor is present in a powdered from prior to polymerization or curing. The oligomeric aminoplast resin of the invention can be present in either a liquid or a powdered form.

The advantage of the abrasive article of this invention over those of the prior art is the ability to reduce costs by mixing the relatively expensive oligomeric aminoplast resin with less expensive thermally curable resin, and elimination of festoon ovens. The abrasive article of this invention exhibits improved abrading performance under severe grinding conditions, especially wet conditions, as compared with abrasive articles containing peevishly known radiation curable binds.

The following non-limiting examples will further illustrate the invention. All coating weights are specified in grams/square meter ($g/m^2$). All resin formulation ratios are based upon weight. However, the percentage of photoinitiator, e.g., PH1, is based upon weight of the resin components and filler components. Thus, the sum of percentages of ingredients will exceed 100% when a photoinitiator is used. The stock removal of the coated abrasive products tested below represent an average of at least two belts or discs.

In the subsequent examples, the following abbreviations are used:

AMP: Monomeric aminoplast made in manner similar to Preparation 4 of U.S. Pat. No. 4,903,440

PH1: 2,2-dimethoxy-1,2-diphenyl-1-ethanone (photoinitiator)

CMS: calcium metasilicate filler, purchased from the Nyco Company, under the trade designation "Wollastokup"

PREPARATION A

Preparation A demonstrates a method for preparing a novolac phenolic resin designated hereinafter as PN1.

A two-liter, three-neck flask was fitted with a reflux condenser and a mechanical stirrer. A 37% aqueous formaldehyde solution (535.2 g), phenol (1128 g), and oxalic acid (13.4 g) were charged into the flask. The contents of the flask were heated to reflux for three hours. Next, a distillation head and receiving flask were installed onto the flask. Then, water was distilled at atmospheric pressure and at a flask temperature of 155° C. After the distillation had subsided, a water aspirator vacuum was applied to remove the water remaining. The distillation process was continued until the phenol began to distill. The resulting product in the flask was a viscous liquid novolac phenolic resin.

PREPARATION B

Preparation B demonstrates a method for preparing an oligomeric aminoplast having on average at least one pendant $\alpha,\beta$-unsaturated carbonyl group per oligomeric unit. This material was an acrylamidomethylated novolac phenolic resin designated hereinafter as AMN1.

A two-liter, three-neck flask was fitted with a reflux condenser and a mechanical stirrer. A 37% aqueous formaldehyde solution (69 g), acrylamide (151 g), and 95% pure paraformaldehyde (53.7 g) were charged into the flask. The contents of the flask were stirred and warmed to about 45° to 50° C. with an oil bath. A creamy suspension formed, and at this point five drops of a 50% aqueous sodium hydroxide solution was added to the flask. The contents of the flask were stirred continuously until a clear solution formed. Next, acrylamide (151 g) and paraformaldehyde (53.7 g) were added to the flask. The contents of the flask were stirred continuously and warmed with the oil bath until a clear solution formed again. Once the clear solution was formed, stirring was continued for an additional 20 minutes. Next, PN1 (novolac phenolic resin from Preparation A, 340 g) and eight drops of methanesulfonic acid were added to the flask. The temperature of the oil bath was gradually raised to 80° C., and a solution of 2.8 grams of methanesulfonic acid in 70 ml of 2-ethoxyethanol was added. The contents of the flask were held at 80° C. for three hours, and then the oil bath was removed. The reaction product was neutralized by the action of 2.2 g of a 50% aqueous solution of sodium hydroxide. The product was a viscous creamy liquid containing about 85% solids.

PREPARATION C

Preparation C demonstrates a method for preparing an oligomeric aminoplast having on average at least one pendant $\alpha,\beta$-unsaturated carbonyl group per oligomeric unit. This material is an acrylamidomethylation of novolac phenolic resin designated hereinafter as AMN2.

Into a one-liter, three-neck flask equipped with a paddle stirrer, heating mantle, and thermometer were added 282.3 g (3 moles) of molten phenol. The temperature was maintained at 50° C. and the contents of the flask were stirred continuously. Next, p-toluenesulfonic acid hydrate (0.8 g) was added to the phenol. The addition resulted in an exotherm, which raised the temperature of the mixture to about 70° C. Then, in 10% increments, 91% pure paraformaldehyde (66 g, 2 moles) were added to the flask such that the temperature was maintained at about 90° C.

After all the paraformaldehyde had been added and the exotherm had subsided, the temperature was raised so as to cause reflux, and this temperature was maintained for two hours. Next, phenothiazine (0.2 g) was added to the flask. The contents were then cooled to 70° C. and 48% aqueous N-methacrylamide (840 g, 4 moles) was added, which resulted in the cooling of the flask's contents to a temperature of about 50° C. The temperature of the flask's contents were raised to 80° C. and held for 2 ½ hours. Then potassium acetate (1.0 g of a 50% solution) was added to the flask and the resulting mixture stirred for five additional minutes. The contents of the flask were then cooled to 60° C. Stirring was discontinued, thereby allowing the reaction product, i.e., the resin, to settle to the bottom of the flask. When the temperature of the reaction product reached 40° C., the resin layer was removed from the flask. The yield of resin was approximately 500 g.

PREPARATION D

Preparation D demonstrates a method for preparing a novolac phenolic resin designated hereinafter as PN3.

In a one-liter, three-neck flask were charged molten phenol (300.7 g, 3.2 moles) and anhydrous oxalic acid (16 g, 0.18 mole). The flask was equipped with a paddle stirrer, a heating mantle, and a thermometer. The temperature was held at 50° C. as 91% pure paraformaldehyde (52.5 g, 1.6 moles) was added portion-wise to the flask, while the temperature was maintained at or below 90° C. After the addition of the paraformaldehyde, and after the exotherm had subsided, the contents of the flask were refluxed for two hours.

PREPARATION E

Preparation E demonstrates a method for preparing an oligomeric aminoplast having on average at least one pendant $\alpha,\beta$-unsaturated carbonyl group per oligomeric unit. This material is an acrylamidomethylation of novolac phenolic resin designated hereinafter as AMN3.

Into a two-liter flask equipped as in Preparation C was charged a 37% aqueous formaldehyde (81 g, 1 mole). The formaldehyde was stirred as acrylamide (71.1 g, 1 mole), followed by phenothiazine (0.06 g) were added thereto. The pH of the resulting mixture was adjusted to about 8 by means of a 50% aqueous NaOH solution. The temperature of the mixture was raised to 45° C. as acrylamide (497.5 g, 7 moles) and 91% pure paraformaldehyde (231 g, 7 moles) were added to the flask in 10% increments. The temperature of the mixture was maintained below 60° C. The pH was maintained to about 8, with the addition of the 50% aqueous NaOH solution. The reaction mixture was maintained at a temperature of 50° to 55° C. until it clarified. The PN3 from Preparation D was added. The reaction mixture was then heated to a temperature of between 70° C. to 80° C. and maintained for two hours. Next, the reaction mixture was cooled to 60° C. and neutralized with a 50% aqueous potassium acetate solution. The reaction mixture was then cooled to 40° C.

PREPARATIONS F-I

These preparations demonstrate a method for preparing binder precursors of the invention. These binder precursors varied in molecular weights and the level of acrylamidomethyl substitution ($\alpha,\beta$-unsaturated carbonyl group substitution).

PREPARATION F

Into a one-liter, three-neck flask equipped with a paddle stirrer, heating mantle, water-cooled condenser, and thermometer were charged molten phenol (188.2 g, 2 moles), followed by oxalic acid (9.9 g, 0.11 mole). The contents of the flask were stirred, and the temperature was increased to 50° C. Next, 91% prilled paraformaldehyde (33 g, 1 mole) was added to the flask in four portions, so that the temperature of the reaction contents did not exceed 95° C. At the end of the paraformaldehyde addition, the contents of the flask were refluxed for two hours and then cooled to 70° C. the resulting material was designated PN4.

Into a second one-liter, three-neck flask equipped with a paddle stirrer, heating mantle, water-cooled condenser, and thermometer was charged 37% aqueous formaldehyde (56.6 g, 0.7 mole). The formaldehyde was stirred while phenothiazine (0.05 g) was added to the flask, followed by 5 to 6 drops of a 50% aqueous NaOH solution. Next, acrylamide (355.4 g, 5 moles) and 91% prilled paraformaldehyde (141.9 g, 4.3 moles) were added portionwise to the flask in an alternating manner. The time required to add these two components was approximately 0.5 hour, so that good fluidity of the reaction mixture was assured. The contents of the flask were gently heated to 50° C. to assist in the dissolution and the reaction of the arylmide with paraformaldehyde. After the addition of the two components, the reaction temperature was held at 55° C. until the solids dissolved. The resulting clear solution was added in a single portion to the flask that contained the PN4. the combined reaction contents were heated to 70° C. and held at that temperature for two hours. Then a 50% aqueous potassium acetate solution (24 g) was added to the flask. The resulting contents were stirred as the mixture was cooled to 40° C. The resulting material was an acrylamidomethylated phenolic novolac resin and was hereinafter designated AMN4.

PREPARATION G

Into a one-liter, three-neck flask equipped with a paddle stirrer, heating mantle, water-cooled condenser, and thermometer were charged molten phenol (282.3 g, 3 moles), followed by oxalic acid (15 g, 0.16 mole). The contents were stirred as 91% prilled paraformaldehyde (50 g, 1.5 moles) was added to the flask in one portion. The contents of the flask were heated to 75° C., whereupon an exothermic reaction took place. The flask, which contained the reaction contents, was cooled with a water bath to a temperature of about 90° C. Then the reaction contents were refluxed for two hours, and then cooled to 70° C. To these reaction contents were added phenothiazine (0.2 g) and then in three portions solid N-methylolacrylamide (606 g, 6 moles), while the temperature of the contents of the flask was maintained at 70° C., with cooling. The contents of the flask were held at 70° C. for three hours. The flask and contents thereof were cooled to room temperature, and the contents transferred to a container imperious to ultraviolet light. The resulting material was an acylamidomethylated phenolic novolac resin and was hereinafter designated AMN5.

PREPARATION H

Into a one-liter, three-neck flask equipped with a paddle stirrer, heating mantle, water-cooled condenser, and thermometer was charged molten phenol (282.3 g, 3 moles). The temperature of the flask and phenol was maintained at 50° C. The phenol was stirred as p-toluenesulfonic acid hydrate (0.4 g) was added. Next, in 10% increments, 91% prilled paraformaldehyde (66 g, 2 moles) was added to the flask. With each addition of the paraformaldehyde, the temperature of the contents of the flask initially dropped due to the dissolution of the paraformaldehyde, followed by a reaction exotherm, which raised the temperature of the contents of the flask to between about 70° C. to 90° C. After the final addition of the paraformaldehyde, the contents of the flask were heated to reflux for two hours. Next, the reaction contents were cooled to 70° C. and phenothiazine (0.2 g) was added. Then, in one portion, 48% aqueous N-methylolacrylamide (840 g, 4 moles), was added to the flask. The temperature of the flask and contents were raised to 80° C. and maintained at this temperature for 2.5 hours. The resulting reaction contents were neutralized with a 50% aqueous potassium acetate (0.5 g) and then cooled to 60° C. by placing the flask in a water bath. At this point, the stirring was discontinued and the reaction contents were allowed to stand. A two-phase system rapidly formed. When the temperature of the reaction contents reached 40° C., the top aqueous phase was discarded. The lower phase, which weighted approximately 500 g, was a creamy, viscous resin. The resulting material was an acylamidomethylated phenolic novolac resin and was hereinafter designated AMN6.

PREPARATION I

Into a five-liter, Morton flask equipped with a paddle stirrer, heating mantle, water-cooled condenser, and thermometer were charged molten phenol (1506 g, 16 moles). The temperature of the flask and phenol was maintained at 50° C. The phenol was stirred as p-toluenesulfonic acid hydrate (8.0 g) was added. Next, 91% prilled paraformaldehyde (354 g, 10.7 moles) was added to the flask at such a rate that the reaction temperature did not exceed 90° C. This paraformaldehyde addition required approximately 45 minutes and afterwards the reaction contents were refluxed for two hours. Then the reaction contents were cooled to 90° C. Next, into the flask was charged phenothiazine (0.2 g), followed by 48% aqueous N-methylolacrylamide (2688 g, 12.8 moles). the temperature of the reaction contents dropped to about 70° C., The flask and contents were heated to 80° C. and held for two hours at this temperature. Then a 50% aqueous potassium acetate solution (9 g) was added to neutralize the reaction contents and stirring was stopped. The reaction contents were cooled to room temperature in a water bath. The aqueous phase was decanted and discarded, leaving about 3000 g of a creamy, viscous resin. The resulting material was an acylamidomethylated phenolic novolac resin and was hereinafter designated AMN7.

PREPARATION J

Into a five-liter, split resin flask equipped with a heating mantle, water-cooled condenser, paddle stirrer, and thermometer were charged molten phenol (1505 g, 16 moles) and p-toluenesulfonic acid hydrate (8 g). The mixture was stirred as 91% prilled paraformaldehyde (264 g, 8 moles) was added to the flask at such a rate to maintain the temperature of the reaction contents at or below 90° C. This time of addition of the paraformaldehyde was approximately 55 minutes, after which the reaction contents were refluxed for two hours. Next, the reaction contents were cooled to 70° C. and charged with 48% aqueous N-methylolacrylamide (2700 g, 12.8 moles), followed by phenothiazine (0.2 g). the reaction contents were heated to 80° C. and held at this temperature for two hours. The mixture was then cooled to 65° C. and the stirring was discontinued. The reaction contents were allowed to cool to room temperature overnight and then transferred to a separatory funnel. The bottom, resinous layer was collected and transferred to a container impervious to ultraviolet light. The resulting material was an acylamidomethylated phenolic novolac resin and was hereinafter designated AMN8.

DISC TEST

The Disc Test measures the time required for abrasive grain to shell, i.e., release prematurely from the coated abrasive. Coated abrasive discs (178 cm diameter) made according to the examples having a 2.2 cm mounting hole were attached to a 16.5 cm diameter, 15.2 cm thick hard phenolic backup pad, which was in turn mounted on a 15.2 cm diameter steel flange. The coated abrasive discs were rotated counterclockwise at 3,550 rpm. The 1.8 mm peripheral edge of a 25 cm diameter 4130 carbon steel disc shaped workpiece, oriented at an 18.5° angle from a position normal to the abrasive disc and rotated counterclockwise at 2 rpm, were placed in contact with the grain-bearing face of the abrasive disc under a load of 2.9 kg. The endpoint of the test was 8 minutes or when the disc began to shell. At the end of the test, the workpiece was weighed to determine the amount of metal cut (abraded) from the workpiece. Additionally, the coated abrasive discs were weighed before and after testing to determine how much abrasive grain/bond system was lost during use.

BELT TEST

A coated abrasive belt was installed on a constant rate plunge grinder and was used to abrade the 1.9 1cm diameter face of a 1095 tool steel rod at a rate of 5 seconds/rod until the coated abrasive shelled. The contact wheel was a a serrated 60 Shore A durometer rubber contact wheel. The belt speed was 2250 meters/minute. The experimental error on this test was +/−10%.

COMPARATIVE EXAMPLES A AND EXAMPLES 1-7

Comparative Example A and Examples 1 through 7 demonstrate various embodiments of the invention. The solvent used in these examples was a 50/50 weight blend of water and 2-ethoxyethanol.

COMPARATIVE EXAMPLE A

A conventional coated abrasive fibre disc was made according to the following procedure. A make coat precursor containing 54% by weight of a resole phenolic resin (83% solids) and 46% by weight CMS filler was prepared. This make coat precursor was applied to a 0.76 mm thick vulcanized fibre backing at a wet weight of 180 g/m$^2$. Next, grade 50 heat treated fused aluminum oxide was drop coated into the make coat at a weight of 570 g/m$^2$. The resulting article was precured for 90 minutes at a temperature of 88° C. Next, a size coat precursor was applied over the abrasive grains at a wet weight of 280 g/m$^2$. The size coat precursor consisted of 32% by weight of a resole phenolic resin (76% solids) and 68% by weight cryolite. The resulting coated abrasive was precured for 90 minutes at a temperature of 88° C. and then final cured for 10 hours at a temperature of 100° C. During thermal curing, the resole phenolic resin was polymerized into a thermoset polymer. The discs were then baled and humidified at 45% relative humidity. The discs were flexed prior to being tested according to the Disc Test Procedure. The test results are set forth in Table I.

EXAMPLE 1

The coated abrasive disc of this example was made in the same manner as that of Comparative Example A, except that a different size coat precursor and a different size precure were employed. The size coat precursor consisted of 32% by weight binder precursor and 68% by weight cryolite. The binder precursor (76% solids) consisted of 25% by weight AMN1, 0.375% by weight PH1, and 75% by weight resole phenolic resin. After the size coat precursor had been applied, the coated abrasive surface was exposed four times at 305 cm/minute to a single Fusion Systems 300 watts/inch "D" bulb. Then the coated abrasive article received a thermal precure for 90 minutes at a temperature of 88° C. and a thermal final cure for ten hours at a temperature of 100° C.

EXAMPLE 2

The coated abrasive disc of this example was made in the same manner as that of Comparative Example A, except that a different make coat precursor and a different make coat precure were employed. The make coat precursor consisted of 54% by weight binder precursor and 46% by weight CMS. The binder precursor (86% solids) consisted of 50% by weight AMN1, 0.76% by weight PH1, and 50% by weight resole phenolic resin. After the abrasive grains had been applied, the coated abrasive surface was exposed three times at 305 cm/minute to a single Fusion Systems 300 watts/inch "D" bulb.

EXAMPLE 3

The coated abrasive disc of this example was made in the same manner as that of Example 2, except that a different size coat precursor and a different size coat precure were employed. The size coat precursor consisted of 32% by weight binder precursor and 68% by weight cryolite. The binder precursor (76% solids) consisted of 25% by weight AMN1, 0.375% by weight PH1, and 75% by weight resole phenolic resin. After the size coat precursor had been applied, the coated abrasive surface was exposed four times to ultraviolet light at 305 cm/minute to a single Fusion Systems 300 watts/inch "D" bulb. Then the coated abrasive received a thermal precure for 90 minutes at a temperature of 88° C. and a final thermal cure for ten hours at a temperature of 100° C.

EXAMPLE 4

The coated abrasive disc of this example was made in the same manner as was that of Comparative Example A, except that a different make coat precursor and a different make coat precure were employed. The make coat precursor consisted of 54% by weight binder precursor and 46% by weight CMS. The binder precursor (76% solids) consisted of 60% by weight AMN1, 0.88% by weight PH1, and 40% by weight resole phenolic resin. After the abrasive grains had been applied, the make coat precursor was exposed to ultraviolet light three times at 305 cm/minute to a single Fusion Systems 300 watts/inch "D" bulb.

EXAMPLE 5

The coated abrasive disc of this example was made in the same manner as was that of Example 4, except that a different size coat precursor and a different size coat precure were employed. The size coat precursor consisted of 32% by weight binder precursor and 68% by weight cryolite. The binder precursor (76% solids) consisted of 25% by weight AMN1, 0.375% by weight PH1, and 75% by weight resole phenolic resin. After the size coat precursor had been applied, the coated abrasive surface was exposed to ultraviolet light four times at 305 cm/minute to a single Fusion Systems 300 watts/inch "D" bulb. Next, the coated abrasive received a thermal precure for 90 minutes at a temperature of 88° C. and a final thermal cure for ten hours at a temperature of 100° C.

EXAMPLE 6

The coated abrasive disc of this example was made in the same manner as was that of Comparative Example A, except that a different make coat precursor and a different make coat precure were employed. The make coat consisted of 54% by weight binder precursor and 46% by weight CMS. The binder precursor (76% solids) consisted of 70% by weight AMN1, 1% by weight PH1, and 30% by weight resole phenolic resin. After the abrasive grains had been applied, the coated abrasive surface was exposed to ultraviolet light three times at 305 cm/minute to a single Fusion Systems 300 watts/inch "D" bulb.

EXAMPLE 7

The coated abrasive disc of this example was made in the same manner as was that of Example 6, except that a different size coat precursor and a different size coat precure were employed. The size coat precursor consisted of 32% by weight binder precursor and 68% by weight cryolite. The binder precursor (76% solids) consisted of 25% by weight AMN1, 0.375% by weight PH1, and 75% by weight resole phenolic resin. After the size coat precursor had been applied, the coated abrasive surface was exposed four times at 305 cm/minute to a single Fusion Systems 300 watts/inch "D" bulb. Next, the coated abrasive article received a thermal for 90 minutes at a temperature of 88° C. and a final cure for ten hours at a temperature of 100° C.

TABLE I

| Example | Average cut (g) | % of Comparative Example A | Average disc weight loss (g) |
|---|---|---|---|
| Comparative A | 106 | 100 | 0.5 |
| 1 | 116 | 110 | 0.6 |
| 2 | 121 | 114 | 0.6 |
| 3 | 120 | 113 | 0.8 |
| 4 | 116 | 109 | 0.5 |
| 5 | 108 | 102 | 1.0 |
| 6 | 120 | 114 | 0.6 |
| 7 | 105 | 99 | 1.1 |

These data illustrate that the binder of this invention can equal, and in many instances, exceed the performance of a conventional resole phenolic resin binder.

COMPARATIVE EXAMPLES B, C, D, AND E AND EXAMPLES 8 AND 9

These examples compare the binder precursor of this invention with previously known radiation curable resin that have been blended with a thermally curable phenolic resin. The resulting coated abrasive were converted into 7.6 cm by 355 cm endless abrasive belts and tested according to the Belt Test. The results are set forth in Table II and Table III. For Table III, each coated abrasive belt was given an additional thermal cure for five hours at a temperature of 140° C.

COMPARATIVE EXAMPLE B

The coated abrasive belt of this example used acrylated epxoy/phenolic resin blend as the binder precursor in the make coat and a conventional phenolic resin as the binder precursor in the size coat. The backing for the coated abrasive was a Y weight sateen (four over one weave) polyester cloth backing. The backing contained a conventional latex/phenolic resin saturant coating, a latex/phenolic resin/calcium carbonate backsize coating, and a latex/phenolic resin presize coating. A binder precursor for the make coat consisting of 194 g of a diacrylated epoxy resin (NOVACURE 3703, Hi-Tek Polymer, Jeffersontown, Ky.), 92 g of acrylated epoxy resin (RDX 80827, Hi-Tek Polymer, Jeffersontown, Ky.), 23 g of tetraethylene glycol diacrylate, 330 g of a resole phenolic resin (CR-3575, Clark Chemical Co.), 103 g of N-vinyl pyrrolidone, 19.4 g of tetraethylene glycol diacrylate, 0.5 g of a surfactant (FC-430, Minnesota Mining and Manufacturing Company, St. Paul, Minn.), 0.5 g of a surfactant (MODAFLOW, Monsanto Company, St. Louis, Mo.), 1.5 g of a surfactant (W-980, BYK Chemie), and 4.8 g of a black pigment (PDI-1800, Pigment Dispersions, Inc.) was prepared. The make coat precursor consisted of the binder precursor combined with 233 of calcium carbonate filler. The make coat precursor contained approximately 44% by weight radiation curable resin, 33% by weight phenolic resin, and 23% by weight filler. The make coat precursor was applied to the backing at an average wet weight of 230 g/m$^2$. Then, grade 50 heat treated aluminum oxide abrasive grains were applied over the make coat at a weight of 612 g/m$^2$. The backing/make coat/abrasive grain composite was exposed to an electron beam at 6 meters/minute, 600 KeV and 5 megarads to partially cure the make coat. The size coat precursor consisted of 48% by weight resole phenolic resin as the binder precursor and 52% by weight calcium carbonate. The size coat precursor was diluted with solvent to 78% solids. The size coat precursor was applied at average wet weight of 240 g/m$^2$. After the size coat precursor had ben applied, the resulting material was placed in a festoon oven and precured for 90 minutes at a temperature of 88° C., and final cured for 10 hours at a temperature of 100° C. The coated abrasive material was flexed and converted into endless belts. These belts were tested according to "Belt Test Procedure" and the results are set forth in Table II.

COMPARATIVE EXAMPLE C

The coated abrasive belt of the example was made and tested in the same manner as was that of Comparative Example B, except that a different make coat precursor was employed. The make coat precursor consisted of 12.5 kg of binder precursor and 3.6 kg of calcium carbonate. The binder precursor contained 7.4 kg of AMP and 5.1 kg of a resole phenolic resin. The AMP contained 90% solids, and the resole phenolic resin contained 74% solids. Water was added to the make coat precursor to reduce the overall solids content to 88%.

COMPARATIVE EXAMPLE D

The coated abrasive belt of the example was made and tested in the same manner as was that of Comparative Example B, except that a different make coat precursor was employed. The make coat precursor consisted 10.4 kg of binder precursor and 9.36 kg of calcium carbonate. The binder precursor contained 4.8 kg of AMP and 5.6 kg of a resole phenolic resin. The AMP contained 90% solids, and the resole phenolic resin contained 74% solids. Water was added to the make coat precursor to reduce the overall solids content to 90%. The dose of the electron beam was increased to 10 megarads from 5 megarads.

COMPARATIVE EXAMPLE E

The coated abrasive belt of this example was a commercially available product having the designation THREE-M-ITE Resin Bond Cloth type ZB coated abrasive, commercially available from Minnesota Mining and Manufacturing Company, St. Paul, Minn.

EXAMPLE 8

The coated abrasive belt of the example was made and tested in the same manner as was that of Comparative Example B, except that a different make coat precursor was employed. The make coat precursor consisted of 13 kg of binder precursor and 3.6 kg of calcium carbonate. The binder precursor consisted of 8.3 kg of AMN2 and 4.7 kg of a resole phenolic resin. The AMN2 contained 80% solids, and the resole phenolic resin contained 82% solids. Solvent was added to the make coat precursor to reduce the overall solids content to 85%.

EXAMPLE 9

The coated abrasive belt of the example was made and tested in the same manner as was that of Comparative Example B, except that a different make coat precursor was employed. The make coat precursor consisted of 10.67 kg of binder precursor and 9.36 kg of calcium carbonate. The binder precursor contained 5.4 kg of AMN2 and 5.27 kg of a resole phenolic resin. The AMN2 contained 80% solids, and the resole phenolic resin contained 82% solids. Water was added to the make coat precursor to reduce the overall solids content to 90%. The dose of the electron beam was increased to 10 megarads from 5 megarads.

TABLE II

| Example | Total cut (g) | % of Comparative Example E |
|---|---|---|
| Comparative E | 349.7 | 100 |
| Comparative B | 37.1 | 10.6 |
| Comparative C | 108.5 | 31 |
| Comparative D | 266.2 | 76 |
| 8 | 194 | 55 |
| 9 | 266.9 | 76 |

TABLE III

| Example | Total cut (g) | % of Comparative Example E |
|---|---|---|
| Comparative E | 349.7 | 100 |
| Comparative C | 189.1 | 54 |
| Comparative D | 331.9 | 95 |
| 8 | 248.5 | 71 |
| 9 | 382.8 | 109 |

COMPARATIVE EXAMPLE F AND EXAMPLES 10–17

These examples compared the grinding performance of coated abrasive articles containing various acrylamidomethylated phenolic novolac resins. The coated abrasive articles were tested according to the Belt Test procedure, Wet Surface Grinding Test, and the Dry Surface Grinding Test. The Wet Surface Grinding Test was essentially the same test as described in U.S. Pat. No. 4,903,440, column 15, lines 41–57, under the heading "TP4 : Test Procedure Four", incorporated herein by reference, except that the metal wheel speed was 1,674 surface feet per minute. The Dry Surface Grinding Test was essentially the same test as described in U.S. Pat. No. 4,903,440, column 15, lines 58–61, under the heading "TP5: Test Procedure Five", incorporated herein by reference, except that the metal wheel speed was 1,674 surface feet per minute. The results are set forth in Tables IV, V, and VI. All of the grinding results are reported as a percent of Comparative Example F.

The backing for this set of examples was Y weight stitchbonded cloth. The backing was saturated with a phenolic/latex resin and then placed in an oven to partially cure the resin. Then a latex/phenolic resin and calcium carbonate solution was applied to the back side of the backing and heated to partially cure the resin. Finally, a latex/phenolic resin was applied to the front side of the cloth and heated to partially cure the resin. The backing was completely treated and was ready to receive the make coat precursor. Additionally, the solvent in this set of examples was a mixture of water and $C_2H_5O(CH_2)_2OH$ in a 90:10 ratio.

COMPARATIVE EXAMPLE F

A make coat precursor that contained 48% by weight of a resole phenolic resin and 52% by weight CMS filler was prepared. This make coat precursor (84% solids) was applied to the backing at a wet weight of 310 g/m$^2$. Next, grade 50 heat treated aluminum oxide (610 g/m$^2$) was electrostatically coated into the make coat precursor. The resulting product was precured for 90 minutes at a temperature of 88° C. Next, a size coat precursor was applied over the abrasive grains at a wet weight of 270 g/m$^2$. The size coat precursor (78% solids) consisted of 48% by weight of a resole phenolic resin and 52% by weight CMS filler. The resulting coated abrasive was precured for 90 minutes at a temperature of 88° C. and then received a final cure of 10 hours at a temperature of 100° C.

EXAMPLE 10

A make coat precursor that contained 28.8% by weight AMN4, 19.2% by weight of a resole phenolic resin, 0.75% by weight PH1, and 52% by weight CMS filler was prepared. This make coat precursor (88% solids) wa applied to the backing at a wet weight of 310 g/m$^2$. Next, grade 50 heat treated aluminum oxide (610 g/m$^2$) was electrostatically coated into the make coat precursor. The resulting product was exposed to two ultraviolet lamps operating at 118 Watts/cm at 4.6 m/min. Next, a size coat precursor was applied over the abrasive grains at a wet weight of 270 g/m$^2$. The size coat precursor (78% solids) consisted of 12% by weight AMN4, 36% by weight of a resole phenolic resin, 0.75% by weight PH1, and 52% by weight CMS filler. The resulting coated abrasive was exposed to two ultraviolet lamps operating at 118 Watts/cm at 4.6 m/min. Then the coated abrasive was cured for 10 hours at a temperature of 100° C., and then cured for four hours at a temperature of 140° C.

EXAMPLE 11

The coated abrasive for Example 11 was made in the same manner as was that of Example 10, except that the size coat precursor (81% solids) consisted of 19.2% by weight AMN4, 28.8% by weight of a resole phenolic resin, 0.75% by weight PH1, and 52% by weight CMS filler.

EXAMPLE 12

The coated abrasive for Example 12 was made in the same manner as was that of Example 10, except that different make coat precursor and size coat precursor were employed. The make coat precursor (88% solids) contained 28.8% by weight AMN6, 19.2% by weight of a resole phenolic resin, 0.75% by weight PH1, and 52% by weight CMS filler. The size coat precursor (81% solids) consisted of 12% by weight AMN6, 36% by weight of a resole phenolic resin, 0.75% by weight PH1, and 52% by weight CMS filler.

EXAMPLE 13

The coated abrasive for Example 13 was made in the same manner as was that of Example 12, except that a different size coat precursor was employed. The size coat precursor (81% solids) consisted of 19.2% by weight AMN6, 28.8% by weight of a resole phenolic resin, 0.75% by weight PH1, and 52% by weight CMS filler.

EXAMPLE 14

The coated abrasive for Example 14 was made in the same manner as was that of Example 10, except that different make coat precursor and size coat precursor were employed. The make coat precursor (88% solids) contained 28.8% by weight AMN7, 19.2% by weight of a resole phenolic resin, 0.75% by weight PH1, and 52% by weight CMS filler. The size coat precursor (81% solids) consisted of 12% by weight AMN7, 36% by weight resole phenolic resin, 0.75% by weight PH1, and 52% by weight CMS filler.

EXAMPLE 15

The coated abrasive for Example 15 was made in the same manner as was that of Example 14, except that a different size coat precursor was employed. The size coat precursor (81% solids) consisted of 16.8% by weight AMN7, 31.2% by weight of a resole phenolic resin, 0.75% by weight PH1, and 52% by weight CMS filler.

EXAMPLE 16

The coated abrasive for Example 16 was made in the same manner as was that of Example 10, except that different make coat precursor and size coat precursor were employed. The make coat precursor (88% solids) contained 28.8% by weight AMN8, 19.2% by weight of a resole phenolic resin, 0.75% by weight PH1, and 52% by weight CMS filler. The size coat precursor (81% solids) consisted of 12% by weight AMN8, 36% by weight of a resole phenolic resin, 0.75% by weight PH1, and 52% by weight CMS filler.

EXAMPLE 17

The coated abrasive for Example 17 was made in the same manner as was that of Example 16, except that a different size coat precursor was employed. The size coat precursor (81% solids) consisted of 16.8% by weight AMN7, 31.2% by weight of a resole phenolic resin, 0.75% by weight PH1, and 52% by weight CMS filler.

TABLE IV

| Belt Test | |
|---|---|
| Example | % of Comparative Example F |
| Comparative F | 100 |
| 10 | 93 |
| 11 | 62 |
| 12 | 104 |
| 13 | 90 |
| 14 | 100 |
| 15 | 99 |
| 16 | 117 |
| 17 | 112 |

TABLE V

| Wet Surface Grinding Test | |
|---|---|
| Example | % of Comparative Example F |
| Comparative F | 100 |
| 10 | 89 |
| 11 | 68 |
| 12 | 117 |
| 13 | 92 |
| 14 | 120 |
| 15 | 120 |
| 16 | 131 |

TABLE V-continued

| Wet Surface Grinding Test | |
|---|---|
| Example | % of Comparative Example F |
| 17 | 133 |

TABLE VI

| Dry Surface Grinding Test | |
|---|---|
| Example | % of Comparative Example F |
| Comparative F | 100 |
| 10 | 59 |
| 11 | 40 |
| 12 | 132 |
| 13 | 62 |
| 14 | 90 |
| 15 | 88 |
| 16 | 114 |
| 17 | 111 |

These results illustrate that the structure of the oligomeric aminoplast resin of this invention can be optimized so that abrasive products containing same can consistently outperform currently available products under severe grinding conditions.

Various modifications and alterations of this invention will become apparent to those skilled in the art without departing from the scope and spirit of this invention, and should be understood that this invention is not to be unduly limited to the illustrated embodiments set forth herein.

What is claimed is:

1. An abrasive article comprising abrasive grains, and at least one binder formed from a precursor comprising an oligomeric aminoplast resin having on average at least one pendant $\alpha,\beta$-unsaturated carbonyl group per oligomeric unit.

2. The abrasive article of claim 1, wherein said oligomeric aminoplast resin further has at least one pendant —NHR or —OH functional group, where R represents a hydrogen atom or a substituted or unsubstituted hydrocarbon group, provided that if the hydrocarbon group is substituted, the substituent or substituents do not inhibit or prevent polymerization of said aminoplast resin.

3. The abrasive article of claim 2, wherein said precursor further comprises at least one condensation curable resin.

4. The abrasive article of claim 3, wherein said condensation curable resin is selected from the group consisting of phenolic, melamine, and urea resins.

5. The abrasive article of claim 2, wherein said precursor further comprises at least one ethylenically unsaturated compound.

6. The abrasive article of claim 5, wherein said precursor further comprises at least one condensation curable resin.

7. The abrasive article of claim 1, wherein said precursor further comprises at least one ethylenically unsaturated compound.

8. The abrasive article of claim 7, wherein said ethylenically unsaturated compound is selected from the group consisting of ethylene glycol diacrylate, trimethylolpropane triacrylate, pentaerythritol triacrylate diacrylate of bisphenol A, ethoxylated diacrylate of bisphenol A, N-vinyl-2-pyrrolidone, styrene, aliphatic urethane acrylate, divinyl benzene, and triacrylate of tris(hydroxyethyl) isocyanurate.

9. The abrasive article of claim 1, wherein said precursor further comprises at least one condensation curable resin.

10. The abrasive article of claim 1, wherein said oligomeric aminoplast resin is selected from the group consisting of urea aldehydes, melamine aldehydes, guanamine aldehydes, aniline aldehyde, toluenesulfonamide aldehydes, ethyleneurea aldehydes, and mixtures thereof.

11. The abrasive article of claim 1, further comprising a thermal curing catalyst.

12. The abrasive article of claim 1, wherein said binder further comprises a component selected from the group consisting of fillers, coupling agents, surfactants, wetting agents, plasticizers, fibers, dyes, pigments and grinding aids.

13. The abrasive article of claim 1, wherein said precursor further comprises at least one photoinitiator.

14. The abrasive article of claim 1, wherein said article is a bonded abrasive.

15. The abrasive article of claim 1, wherein said abrasive article is a lofty, polymeric filmanetous structure having abrasive grains distributed throughout said structure and secured therein by said binder.

16. An abrasive article comprising abrasive grains which are supported on and adherently bonded to at least one major surface of a backing sheet by a make coat of a first binder material and a size coat of a second binder material, at least one of said first binder material or said second binder material being formed from a precursor comprising an oligomeric aminoplast resin having on average at least one pendant $\alpha,\beta$-unsaturated carbonyl group per oligomeric unit.

17. The coated abrasive article of claim 16, wherein said oligomeric aminoplast resin further has at least one pendant —NHR or —OH functional group, where R represents a hydrogen atom or a substituted or unsubstituted hydrocarbon group, provided that if the hydrocarbon group is substituted, the substituent or substituents do not inhibit or prevent polymerization of said aminoplast resin.

18. The coated abrasive article of claim 17, wherein said precursor further comprises at least one condensation curable resin.

19. The coated abrasive article of claim 18, wherein said condensation curable resin is selected from the group consisting of phenolic, melamine, and urea resins.

20. The coated abrasive article of claim 17, wherein said precursor further comprises at least one ethylenically unsaturated compound.

21. The coated abrasive article of claim 20, wherein said precursor further comprises at least one condensation curable resin.

22. The coated abrasive article of claim 16, wherein said precursor further comprises at least one ethylenically unsaturated compound.

23. The coated abrasive article of claim 22, wherein said ethylenically unsaturated compound is selected from the group consisting of ethylene glycol diacrylate, trimethylolpropane triacrylate, pentaerythritol triacrylate diacrylate of bispenol A, ethoxylated diacrylate of bisphenol A, N-vinyl-2-pyrrolidone, styrene, aliphatic urethane acrylate, divinyl benzene, and triacrylate of tris(hydroxyethyl) isocyanurate.

24. The coated abrasive article of claim 16, wherein said aminoplast resin is selected from the group consisting of urea aldehydes, melamine aldehydes, guanamine aldehydes, aniline aldehyde, toluenesulfonamide aldehydes, ethyleneurea aldehydes, and mixtures thereof.

25. The abrasive article of claim 16, wherein said abrasive grains are selected from the group consisting of flint, garnet, aluminum oxide, alumina zirconia, diamond, and silicon carbide.

26. The coated abrasive article of claim 16, further comprising a thermal curing catalyst.

27. The coated abrasive article of claim 16, wherein said binder further comprises a component selected from the group consisting of fillers, coupling agents, surfactants, wetting agents, plasticizers, fibers, dyes, pigments and grinding aids.

28. The coated abrasive article of claim 16, wherein said precursor further comprises at least one photoinitiator.

29. A coated abrasive article comprising abrasive grains which are supported on and adherently bonded to at least one major surface of a backing sheet by a binder material formed from a precursor comprising an oligomeric aminoplast resin having on average at least one pendant $\alpha,\beta$-unsaturated carbonyl group per oligomeric unit.

30. A coated abrasive article comprising a backing, a make coat, a layer of abrasive grains, and a size coat, wherein said backing has at least one of a saturant coat, a presize coat, or a backsize coat, wherein at least one on said saturant coat, said presize coat, or said backsize coat is formed from a precursor comprising an oligomeric aminoplast resin having on average at least one pendant $\alpha,\beta$-unsaturated carbonyl group per oligomeric unit.

* * * * *

UNITED STATES PATENT AND TRADEMARK OFFICE

CERTIFICATE OF CORRECTION

PATENT NO. : 5,236,472

DATED : August 17, 1993

INVENTOR(S) : Kirk et al.

It is certified that error appears in the above-indentified patent and that said Letters Patent is hereby corrected as shown below:

Col. 1, line 65, "acyrlated" should be --acrylated--.

Col. 2, line 49, "boded" should be --bonded--.

Col. 4, line 4, "resins" should be --resin--.

Col. 14, line 34, "40" should be --400--.

Col. 18, line 48, "PN4. the" should be --PN4. The--.

Col. 19, line 41, "weighted" should be --weighed--.

Col. 20, line 55, "1.9 1cm" should be --1.91 cm--.

Col. 23, line 36, "epxoy" should be --epoxy--.

Col. 29, line 7, "aldehyde" should be --aldehydes--.

Col. 29, line 25, in claim 16, "An abrasive article" should be --A coated abrasive article--.

Col. 30, line 20, in claim 25, "The abrasive article" should be --The coated abrasive article--.

UNITED STATES PATENT AND TRADEMARK OFFICE

CERTIFICATE OF CORRECTION

PATENT NO. : 5,236,472

DATED : August 17, 1993

INVENTOR(S) : Kirk et al

It is certified that error appears in the above-indentified patent and that said Letters Patent is hereby corrected as shown below:

Col. 30, line 45, "on" should be --of--.

Signed and Sealed this

Twenty-second Day of November, 1994

*Attest:*

Bruce Lehman

BRUCE LEHMAN

*Attesting Officer*

*Commissioner of Patents and Trademarks*